US006836902B2

(12) United States Patent
Marquez et al.

(10) Patent No.: US 6,836,902 B2
(45) Date of Patent: Jan. 4, 2005

(54) INFANT WALKING TRAINER AND CARRIER GARMENT

(76) Inventors: Alejandra G. Marquez, 3030 B St., San Diego, CA (US) 92102; Maria G. Pulido, 3030 B St., San Diego, CA (US) 92102

( * ) Notice: Subject to any disclaimer, the term of this patent is extended or adjusted under 35 U.S.C. 154(b) by 50 days.

(21) Appl. No.: 10/241,049

(22) Filed: Sep. 10, 2002

(65) Prior Publication Data

US 2004/0045073 A1 Mar. 11, 2004

(51) Int. Cl.[7] ..... A41D 11/00
(52) U.S. Cl. ..... 2/69; 2/80; 224/160
(58) Field of Search ..... 2/69, 94, 69.5, 2/102, 300, 301, 311, 312, 80, 111, 75, 267, 83, 108, 44, 45, 327, 463; 182/3, 4, 6, 7; 128/875; 119/907, 857, 769, 770, 497, 416, 496; 224/160, 161, 153, 578, 643, 648; 5/655; 297/484, 467; D30/1; D3/214

(56) References Cited

U.S. PATENT DOCUMENTS 735,668 A * 8/1903 Heitmann ..... 2/69
1,178,397 A * 4/1916 Harvey ..... 297/275
1,749,999 A 3/1930 Crocker
2,212,746 A * 8/1940 Nelson ..... 119/770
2,568,304 A * 9/1951 Schoenbrun ..... 119/770
2,621,327 A * 12/1952 Amoroso ..... 2/467
2,719,568 A * 10/1955 Webb ..... 482/68
3,237,939 A 3/1966 Olivet et al.
3,481,517 A * 12/1969 Aukerman ..... 224/160
3,778,052 A 12/1973 Andow et al.
4,037,764 A * 7/1977 Almosnino et al. ..... 224/160
4,117,840 A * 10/1978 Rasure ..... 128/874
4,139,131 A * 2/1979 Hathaway ..... 224/160
4,149,687 A * 4/1979 Nunemacher ..... 224/159
4,234,229 A * 11/1980 Arnold ..... 297/467
4,308,629 A * 1/1982 Freemon ..... 441/111
4,428,514 A * 1/1984 Elf ..... 224/579
4,467,945 A * 8/1984 Schaapveld ..... 224/160
4,469,259 A * 9/1984 Krich et al. ..... 224/160
4,625,335 A * 12/1986 Vinai ..... 2/69
D290,178 S * 6/1987 Nissen ..... D30/109
4,731,882 A * 3/1988 Ekman ..... 2/69
4,981,110 A 1/1991 Llewellyn
4,986,458 A * 1/1991 Linday ..... 224/160
5,074,795 A * 12/1991 Clark ..... 434/253
5,120,287 A 6/1992 Brown et al.
5,176,102 A * 1/1993 Tracy ..... 119/497
5,205,450 A * 4/1993 Derosier ..... 224/161
5,205,451 A * 4/1993 Manzer ..... 224/161
5,356,355 A 10/1994 Campbell
5,361,952 A * 11/1994 Gold ..... 224/159
5,369,804 A * 12/1994 Metcalf ..... 2/69
5,388,551 A 2/1995 Martusciello
5,435,272 A * 7/1995 Epstein ..... 119/770
5,459,874 A * 10/1995 Meredith ..... 2/67
5,476,070 A * 12/1995 Gwon et al. ..... 119/770
5,542,123 A * 8/1996 DiPietro ..... 2/80

(List continued on next page.)

*Primary Examiner*—Katherine Moran
*Assistant Examiner*—Alissa L. Hoey
(74) *Attorney, Agent, or Firm*—Higgs Fletcher & Mack, LLP; Charles F. Reidelbach, Jr.

(57) ABSTRACT

Disclosed is a device for producing a safe and effective infant walking trainer and carrier garment to assist the parents with the training and care of their children. Too many articles in the care and handling of infants have been found to be a danger to the infant and in some cases have caused fatalities of infants even with very attentive parents. When we purchase an article designed for children we assume it is safe, but it has been proven that many are not. Safety in the design of devices in the field of childcare must be of the utmost importance.

13 Claims, 2 Drawing Sheets

U.S. PATENT DOCUMENTS 5,766,114 A 6/1998 Campbell
5,791,535 A * 8/1998 Roan et al. ..... 224/160
5,813,580 A * 9/1998 Fair ..... 224/160
5,894,817 A * 4/1999 Manuel ..... 119/497
5,921,345 A * 7/1999 Cheng ..... 182/7
5,927,235 A * 7/1999 Olaiz ..... 119/770
5,996,153 A 12/1999 Slater et al.
6,122,778 A * 9/2000 Cohen ..... 5/81.1 R
6,125,792 A * 10/2000 Gee ..... 119/770
6,196,949 B1 3/2001 Rodarte
RE37,394 E * 10/2001 Woodyard ..... 2/102
D453,066 S * 1/2002 Norman ..... D3/214
6,338,699 B1 1/2002 Veitch
6,361,478 B1 * 3/2002 Giancaspro ..... 482/69
6,397,389 B1 6/2002 Schultz
6,398,088 B1 * 6/2002 Burke ..... 224/160
6,520,391 B2 * 2/2003 Yen ..... 224/160
6,598,771 B2 * 7/2003 Norman ..... 224/160
6,666,361 B1 * 12/2003 Lin ..... 224/160

* cited by examiner

INFANT WALKING TRAINER AND CARRIER GARMENT

FIELD OF THE INVENTION

This invention deals with a garment used in the act of training infants to walk, with the added benefit that by relocating and shortening the lifting straps and adding the swing style seat, it becomes a unique infant carrier, with still another benefit of being able to attach just one of the lifting straps to the garment so that the device may be used to restrain the infant after they begin to walk more actively. More specifically, this is a garment that can be put on the infant to wear with quick disconnect buckles to attach or remove the lifting straps or the swing style seat.

BACKGROUND OF THE INVENTION

Young infants before they have started walking, spend most of their time in the prone position or lying on their backs. It is not until they begin to crawl and start holding their heads up that they should be encouraged to learn to walk, but gaining their balance is the major problem. Often during these times the infants fall and may incur serious injuries hitting themselves on the corners of furniture in the home. Some harness devices are on the market but they tend to be just straps that are not comfortable for the infants and they generally lift under the arms, the thin straps concentrate the lifting force in small areas rather than being a garment fully enclosing the infant and spreading the lifting forces throughout the entire garment with addition of a padded belt attached across the chest area. With this device a user can raise the infant into a semi-vertical position where they have the security of being held without the worry of falling. Additionally, this device keeps the infant in the semi-vertical position so the support is on the chest and crotch areas, rather than in the straight vertical position where the infant has the feeling of falling backward. This position lets the infant gain confidence in approaching the upright position while not being too far from the prone or crawling position that they are used to. Another added advantage to the device is that after the child starts actively walking, one end of a single lifting strap can be attached to the garment at any one of several places, to be used as a restraining device.

Other similar devices tend to be single purpose articles only to be put on during the training period. Whereas, the disclosed device has the convenience of being able to be put on, and left on for a period of play time, and then by attaching the lifting straps can be used as a walking trainer. By relocating the attachment buckles at the shoulders and shortening the lifting straps, and attaching the swing style seat, the infant can be carried by an user with the device used as a conventional infant carrier, where the straps go over the shoulders and the child is carried in front of the user.

This device may be made from a nylon mesh or any other suitable fabric while employing a minimal amount of belting and buckles. It offers an affordable and safe device that can be easily stored in a very small container.

U.S. Pat. No. 1,749,999 of Edna L. Crocker describes a manually held supporting device for assisting children in learning to walk. The object of this invention is to supply a body band which is adapted to secure upon a child, and which provides relatively long loop members which are secured to the back of the band and which are held by the attendant in supporting a child in position to walk. Although this device holds the infant in the forward leaning position, it is only secured by tightening the device around the upper torso with no support through the crotch, allowing the device to slide up and bind under the arms. Additionally this device must be removed when not in use because the straps are permanently attached and could inadvertently wrap around the child's neck.

U.S. Pat. No. 3,237,939 of William M. Olivet et al, teaches of a baby walking aid, and more particularly to such a means comprising a holding bar which is adapted to be held by an user, the bar being provided with hand holds for the baby. This device can only be used as a walking trainer and holds the child in a more vertical up-right position and does not present itself as any form of garment.

U.S. Pat. No. 3,778,052 of Paul Andow et al, describes a wheeled support structure defining an open framework enclosure including an adjustable height crotch sling and belt assembly. This device is similar to the common rolling walkers on the market, and it does not have the feature of having the personal control by a user.

U.S. Pat. No. 4,981,110 of Giannina Llewellyn discloses an invention comprised of a baby walker organization with a one-piece harness to overlie a child's torso with a front panel and a back panel interconnected by a bottom web with leg apertures positioned to either side of the bottom web. This device is similar to the Crocker device with the improvement of the crotch support and the ability to be used as a backpack style of carrying device for the child. It is well understood that carrying a child in the backpack style is both uncomfortable for the user and the child. The preferred position of carrying an infant is in the front where the user can always be aware of the condition of the child and the load is placed on the central area of the back. Also with the straps as an integral part of the device, it must be removed immediately after being used due to the fact that the belt could rap around the baby's neck.

U.S. Pat. No. 5,120,287 of Linda E. Brown teaches of a walking aide for supporting an infant. The walking aide includes a harness mechanism for enclosing and supporting the infant therein, with a cross bar to be held by the operator, and a second bar to be grasped by the infant. This device has no upper body support and produces a tipping action if the child does not hold onto the bar.

U.S. Pat. No. 5,356,355 of Douglas Campbell describes an infant walking aide device, which helps a user to assist a small child or toddler in learning to walk. A fully adjustable harness supported by a crossbar, which is held by the user. These forms of harness style devices with conjoined straps have proven to be very dangerous if not fatal with small infants, where the straps can inadvertently get around the infants neck.

U.S. Pat. No. 5,388,551 of Jack Martusceillo discloses an invention that relates to a convertible harness system and more particularly to a multi-use harness system, which can be used to assist and support a child while the child is learning to walk. The harness system may also be attached to a tether to restrain the child once the child has learned to walk. The harness system may also include a carrier assembly so that the child may be supported and carried in the chest area of the parent or attendant. This is another strap style of infant paraphernalia that has proven very dangerous to children.

U.S. Pat. No. 5,766,114 of Douglas O. Campbell teaches of an infant walking and swimming aide comprising a harness having at least one adjustable shoulder strap, a lower adjustable body belt, an upper adjustable body belt, at least one crotch strap, and a high back belt. This is still another dangerous device using many belts wrapping around the infant.

U.S. Pat. No. 6,397,389 of Nils C. Shultz describes an invention designed to provide a safe comfortable and simple child walking harness to help a child to learn to walk and provide a non restrictive range of motion, balance and support during the child's early walking attempts by supporting the entire body weight evenly when needed to help cushion missteps, falls and give additional benefit to the parent through the ergonomically designed holding straps, and to minimize low back pain and strain. The child walking harness also provides safety for children after they have learned to walk, especially in public places, and around pools and beaches. Although this inventor has endeavored to minimize the use of straps on this device, there is no means to remove the straps from the device, and it does not display the ability of being used as a child carrier.

U.S. Pat. No. 6,196,949 of Ruben Rodarte tells of a portable tubular structure for supporting infants for the purpose of training and assisting infants to walk. This structure comprises a frame, generally U-shaped at the top with at least one J-shaped leg element being attached to the frame, with the J-shaped leg elements being parallel to each other. This device in no way holds the infant in any type of garment, but is a tubular apparatus that relies upon the infant to hold itself on it.

U.S. Pat. No. 6,338,699 of Timothy Dale Veitch describes a child sport activity-training device comprising a harness for enclosing and supporting a torso of a child therein, with a handgrip grasped by the hand of a trainer. This device is still another harness style, more adapted to train an older child to ice skate than an infant to walk. It still presents itself, as a single purpose device, this does not give the support for a small infant that will be given by the herein disclosed infant walking trainer and carrier garment.

Thus there is always a continuing need to improve the convenience and safety of the articles used in the care and training of small infants.

SUMMARY OF THE INVENTION

In view of the foregoing disadvantages and inherent dangers in the known types of harness style infant care and training devices, this inventor has conceived a new and unique infant walking trainer and carrier garment that can easily have the lifting straps removed when not in use. The present invention is basically comprised of a garment made from nylon net or some other suitable fabric with arm and leg orifices, and with the opening at the back, secured by a hook and loop fastener, a zipper, buttons or any other conventional garment attachment means. The garment has a permanently affixed, padded chest support that translates around the front to just behind the arm orifices on each side, with quick disconnect buckles attached by a short strap on each distal end. Attached to the padded chest support in the front are two permanently affixed padded shoulder straps with quick disconnect buckles at their distal ends.

When the device is to be used as a walking trainer, the buckle on the left shoulder strap is connected to the buckle latching portion on the left lifting strap, additionally the buckle latching portion on the opposite end of the left lifting strap is attached to the buckle on the left side of the padded chest support. The right lifting strap will be attached in like manner where the buckle on the right shoulder strap is connected to the buckle latching portion on the right lifting strap, and the buckle latching portion on the opposite end of the right lifting strap is attached to the buckle on the right side of the padded chest support.

When the device is not being used as a walking trainer, the left and right lifting belts are easily removed by disconnecting all the quick disconnect buckles and tucking the buckles on the ends of the padded chest belt into the buckle loops on both sides of the garment, thus allowing that no loose belting is attached to the garment. The attachment of the buckles on the left and right shoulder straps is made at the apex of the shoulders. The reason for the attachment points of the belts, at the distal ends of the padded chest support being just toward the back of each arm orifices, is to tip the infant in the device forward, keeping some of their weight on their feet, creating a more secure feeling while not lifting them completely off of the surface. Also with the access opening to putting the infant into the garment being on the back, there is no pressure from the weight of the infant against the means of attachment or closure of the garment.

When the device is to be used as an infant carrier, the buckles at both distal ends of the padded chest support will remain secured as the buckle latching portion on the left lifting strap is crossed over and attached to buckle on the right shoulder strap, and the buckle latching portion on the right lifting strap be crossed over and connected to the buckle on the left shoulder. The padded swing seat can be added for additional support for larger infants by attaching it to the two additional buckles on the padded chest support adjacent to the connection of the shoulder straps.

With the crossing of the lifting straps and some shortening in the conventional manner, the person using the device simply puts their head through the central portion and their arms through the arm loops and the device can be slipped on as a infant carrier with the crossing of the lifting straps in the center of the back of the person wearing the device for maximum support and comfort.

With the lifting straps and the padded swing style seat removed, the infant can safely play in the garment, or by using only one of the lifting straps the parent can attach one end with the buckle latching portion to any of the quick disconnect buckles and use the device as a restraining device for keeping hold of the infant after they can walk and become a little too active.

As such, those skilled in the art will appreciate that the conception, upon which this disclosure is based, may readily be utilized as a basis for designing of other garments, methods and systems for carrying out the several purposes of the present invention. It is important therefore that the claims be regarded as including such equivalent construction and design insofar as they do not depart from the spirit and scope of the present invention.

The object of this invention is to create a device that has the means to safely train an infant to walk while supporting them in a semi-upright position.

Another object of this invention is to help an infant to gain their balance in a gentle and progressive manner.

Another object of this invention is to create a device that will easily convert into an infant carrier.

Yet another object of this invention is to create a device that is light weight and will fit into a small compartment.

A further object of this invention is to create a device that will be safe for an infant to wear while playing.

A final object of this invention is to create a device whereby only one lifting strap can be attached as an infant restraint when they are actively walking.

These together with other objects and advantages which become subsequently apparent, reside in the details of the construction and operation as more fully hereinafter described and claimed, reference being had to the accompanying drawings forming a part thereof, wherein like numerals refer to like parts throughout.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

Figure 1:
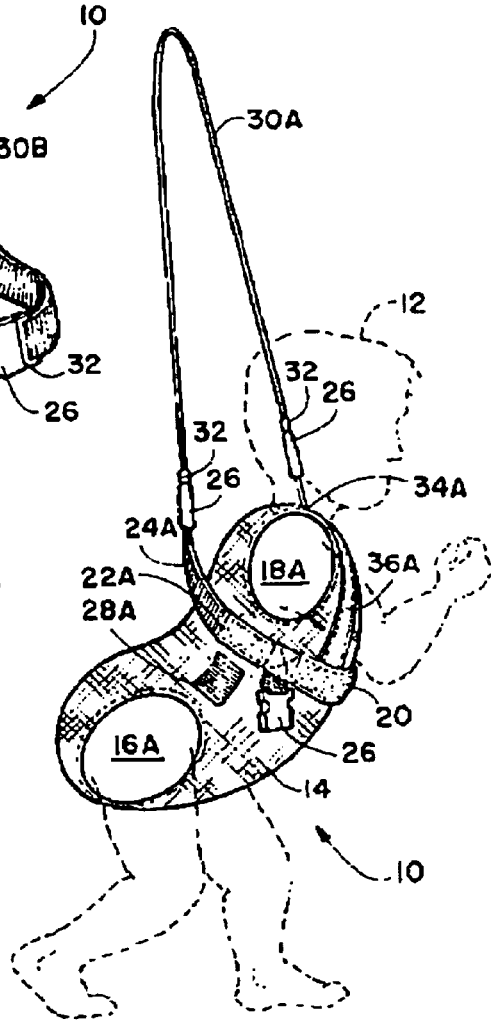
FIG. 1 depicts a side view of the infant walking trainer and carrier garment used as a walking trainer with the infant in phantom.

Referring now to the drawings, wherein similar parts of the invention are identified by like reference numerals, there is seen in FIG. 1 a side view of the infant walking trainer and carrier garment 10 with the infant 12 shown in phantom. The garment fabric 14, right leg orifice 16A and the right arm orifice 18A are displayed with the padded chest support 20 terminating at a point 22A just behind the right arm orifice 18A with a short section of belt 24A extending only long enough to tuck the quick disconnect buckle 26 into the right buckle loop 28A. The lifting strap 30A is shown raised where a user would support the infant 12 in a semi-vertical position. Lifting strap 30A will be attached by the buckle latching portion 32 to the quick disconnect buckle 26 at the apex of the right shoulder 34A above the right arm orifice 18A, while the opposite end of the lifting strap 30A will be attached with the buckle latching portion 32 to the quick disconnect buckle 26 on the distal end of the padded chest support 20.

Figure 2:
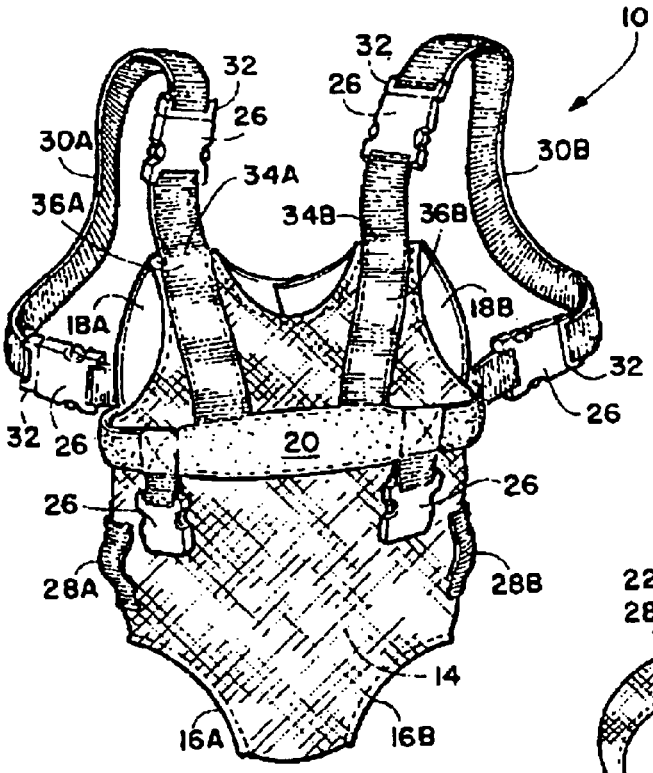
FIG. 2 depicts a front view of the infant walking trainer and carrier garment with the lifting straps attached in the walking trainer configuration.

FIG. 2 depicts a front view of the infant walking trainer and carrier garment 10 in the walking trainer configuration. The two lifting straps 30A and 30B are attached to the right and left shoulder straps 36A and 36B by means of the quick disconnect latch portions 32 engaged into the quick disconnect buckles 26 attached at the apex of the right and left shoulder 34A and 34B above the right and left arm orifices 18A and 18B, of the infant walking trainer and carrier garment 10. The other ends of the lifting straps 30A and 30B are similarly connected by the quick disconnect buckle latching portion 32 engaging the quick disconnect buckles 26 at the respective distal ends of the padded chest support 20. Two additional quick disconnect buckles 26 hang attached to the padded chest support 20 adjacent to the shoulder straps 36A and 36B with the left and right buckle loops 28A and 28B on the sides of the garment 10 above the left and right leg orifices 16A and 16B.

Figure 3:
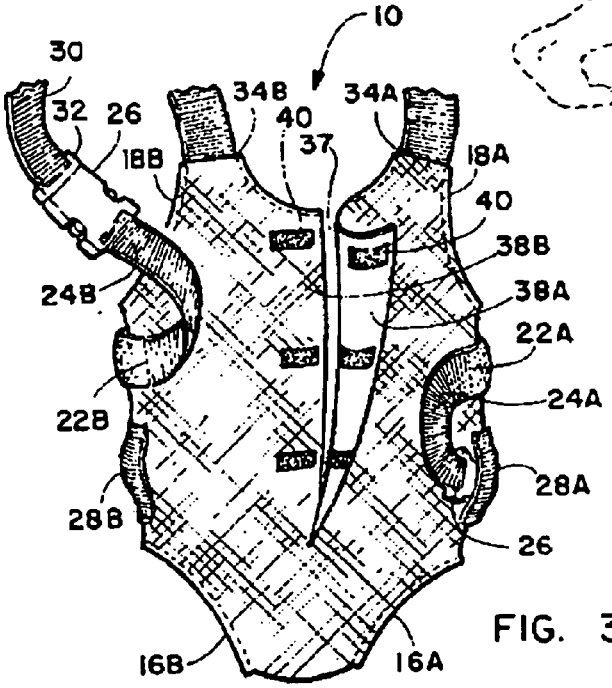
FIG. 3 depicts a rear view of the infant walking trainer and carrier garment with the right buckle at the end of the padded chest protector tucked into the right buckle loop.

FIG. 3 depicts a rear view of the infant walking trainer and carrier garment 10 with the right short section of belt 24A and the quick disconnect buckle 26 tucked into the right buckle loop 28A while the left short section of belt 24B is attached to the lifting strap 30A by means of the quick disconnect buckle latching portion 32 being engaged into the quick disconnect buckle 26. The access opening 37 at the back of the garment 10 is comprised of a right flap 38A and left flap 38B by overlapping, they are attached by the means of hook and loop attachment 40, buttons, a zipper or other conventional attachment means.

Figure 4:
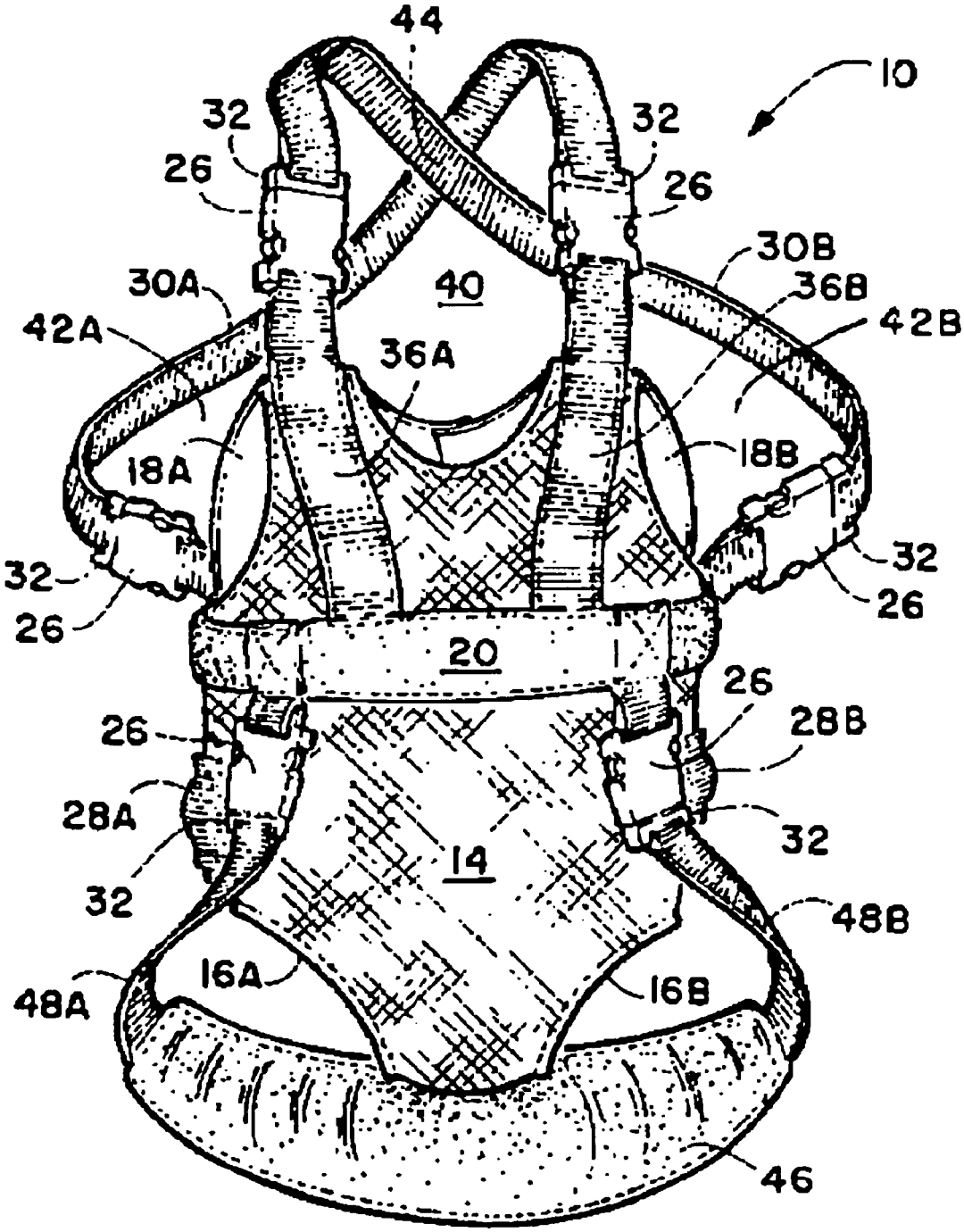
FIG. 4 depicts a front view of the infant walking trainer and carrier garment with the lifting straps crossed and the padded swing seat attached to be used as an infant carrier.

FIG. 4 depicts the front view of the infant walking trainer and carrier garment in the infant carrier configuration, with the left and right lifting straps 30A and 30B crossed. In this configuration the right lifting strap 30A is attached by the means of connecting the quick disconnect latching portion 32 to the quick disconnect buckle 26 attached to the apex of the left shoulder 34B and connecting the quick disconnect latching portion 32 to the quick disconnect buckle 26 attached to the apex of the right shoulder 34A. With the crossing of the right and left lifting straps, 30A and 30B the person using the device simply puts their head through the central portion 40 and their arms through the arm loops 42A and 42B and the device can be slipped on as an infant carrier with the lifting straps 30A and 30B crossing at the center 44 of the back of the person wearing the device for maximum comfort. Additional support is obtained for the infant 12 in the infant walking trainer and carrier garment 10 by attaching the padded swing style seat 46 with the quick disconnect latching portion 32 on the right strap end 48A connected to the quick disconnect buckle 26 on the right side of the padded chest support 20 adjacent to the right shoulder strap 36A, and the left strap end 48B connected to the quick disconnect buckle 26 on the left side of the padded chest support 20 adjacent to the left shoulder strap 36B.

When the lifting straps 30A and 30B and the padded swing style seat 46 have been removed, the infant 12 can play safely in the infant walking trainer and carrier garment 10 without the fear of any straps becoming wrapped around their neck. In this configuration the infant walking trainer and carrier garment 10 can be used as a restraining device by attaching either the left or right lifting strap 30A or 30B to any of the quick disconnect buckles 26 on the garment.

While the present invention has been described herein with reference to particular embodiments thereof, a latitude of modification, various changes and substitutions are intended in the foregoing disclosure, and it will be appreciated that in some instance some features of the invention will be employed without a corresponding use of other features without departing from the scope of the invention as set forth.

We claim:

1. A multi-purpose safety garment wearable by an infant, and by a user as a carrier of the infant, comprising:

a body encircling garment for enclosing the infant therein, said garment having arm and leg orifices;

a lifting means, connected to said garment, for supporting the infant in a semi-vertical position during walking training, wherein said lifting means comprises two lifting straps each having first and second ends, said first ends secured to rear portions of said garment, and said second ends secured to respective top portions oriented on the same side of said garment as said respective first ends, and each of said lifting straps having a release mechanism; and a reconfiguring means for altering said lifting means for further use as infant carrier to secure the infant to the torso of a the user.

2. A multi-purpose garment as recited in claim 1, wherein said top portions are located at the apex of the shoulders just above the arm orifices on each side, and said rear portions are located at the back just behind the arm orifices of each side of e garment.

3. A multi-purpose garment as recited in claim 1, wherein said reconfiguring means includes securing said second ends of said lifting straps to he side of the garment opposite the respective first ends.

4. A multi-purpose garment as recited in claim 1, further comprising a seat assembly secured to said garment.

5. A multi-purpose garment as recited in claim 4, wherein said seat assembly has a soft seat pad contoured to support the rear of the infant, said seat assembly having a set of straps extending from the seat pad, each strap having means for detachably said seat assembly to said garment whereby said seat assembly may be removed from said garment.

6. A multi-purpose garment as recited in claim 1, wherein said garment is made from a fabric.

7. A multi-purpose garment as recited in claim 1, further comprising a releasable closure formed at the back of the garment for ease of entry and removal of the infant.

8. A multi-purpose garment as recited in claim 1, further a padded chest support permanently affixed to said garment and translating around the front of said garment to just behind the arm orifices on each side with a short strap attached to each end thereof.

9. A multi-purpose garment as recited in claim 1, further comprising two shoulder straps permanently affixed to said garment at the apex of the shoulders just above the arm orifices of each side.

10. A multi-purpose garment as recited in claim 1, wherein said first ends are releasably secured to rear portions of said garment for complete detachment of said lifting straps.

11. A multi-purpose support garment wearable by an infant, comprising:

a body encircling garment for enclosing the infant therein, said garment having arm and leg orifices;

a padded chest support permanently affixed to said garment and translating around the front of said garment to just behind the arm orifices on each side with a short strap attached to each end thereof;

two shoulder straps permanently affixed to the garment at the apex of the shoulders just above the arm orifices of each side; and two lifting straps detachably securable to said short straps on one end and said shoulder straps on the other end for supporting said infant in a semi-vertical position during walking training.

12. A multi-purpose support garment as recited in claim 11, wherein said lifting straps are reconfigured to extend across the back and over the shoulders of a user as a carrier of the infant in a criss-cross fashion.

13. A multi-purpose support garment wearable by an infant, comprising:

a body encircling garment for enclosing the infant therein, said garment having arm and leg orifices; and two lifting straps each having first and second ends, said first ends detachably securable to rear portions located at the back just behind the arm orifices of each side of the garment, and said second ends detachably secured to respective top portions located at the apex of the shoulders just above the arm orifices on the same side of said garment as said respective first ends for supporting said infant in a semi-vertical position during walking training.

* * * * *